US006534462B1

(12) United States Patent
Hamilton et al.

(10) Patent No.: US 6,534,462 B1
(45) Date of Patent: Mar. 18, 2003

(54) LIQUID LAUNDRY DETERGENT AND PRETREATMENT COMPOSITION

(75) Inventors: Robert W. Hamilton, Grand Rapids, MI (US); Teresa M. MacLachlan, Ada, MI (US)

(73) Assignee: Access Business Group International LLC, Ada, MI (US)

( * ) Notice: Subject to any disclaimer, the term of this patent is extended or adjusted under 35 U.S.C. 154(b) by 0 days.

(21) Appl. No.: 09/902,427

(22) Filed: Jul. 10, 2001

Related U.S. Application Data

(60) Provisional application No. 60/217,050, filed on Jul. 10, 2000.

(51) Int. Cl.[7] ..... C11D 17/00

(52) U.S. Cl. ..... 510/283; 510/284; 510/403; 510/421; 510/424; 510/426; 510/499; 510/505; 510/506; 510/392

(58) Field of Search ..... 510/403, 421, 510/424, 426, 505, 506, 277, 455, 283, 284, 392

(56) References Cited

U.S. PATENT DOCUMENTS 4,299,740 A 11/1981 Messenger et al.
4,457,857 A 7/1984 Sepulveda et al.
4,717,507 A 1/1988 Schwadtke et al.
4,861,516 A 8/1989 Kurzendoerfer et al.
5,397,493 A 3/1995 Potocki
5,429,765 A 7/1995 Flower
5,573,706 A 11/1996 von Bonin
5,587,356 A 12/1996 Dauderman et al.
5,747,442 A 5/1998 Bory et al.
5,820,637 A 10/1998 Borry et al.
5,865,851 A 2/1999 Sidoti et al.
5,877,141 A 3/1999 Gabriel et al.
5,908,473 A 6/1999 Weller et al.
6,054,424 A 4/2000 Ip

*Primary Examiner*—Necholus Ogden
(74) *Attorney, Agent, or Firm*—Brinks, Hofer, Gilson & Lione; G. Peter Nichols

(57) ABSTRACT

A liquid laundry detergent and pretreatment containing at least one enzyme that is activated upon dilution with water. Upon dilution, the detergent transforms from a watery liquid to a viscous gel. This gel is capable of remaining in place on the garment. The enzyme and surfactants in the formulation work to penetrate and loosen stains so that they are more easily and thoroughly removed during laundering.

14 Claims, No Drawings

LIQUID LAUNDRY DETERGENT AND PRETREATMENT COMPOSITION

This application claims priority to U.S. Serial No. 60/217,050 filed Jul. 10, 2000, the entire contents of which are incorporated herein by reference.

The present invention relates to a liquid laundry detergent and pretreatment composition for difficult to remove stains. The invention combines in a single product an effective laundry detergent with a pre-treatment for removing stains. The pretreatment preparation provides a viscosity increase assuring the consumer that the laundry pretreatment has been activated and insuring additional contact time with the stain for improved performance.

BACKGROUND OF THE INVENTION

Liquid laundry detergents have been known to provide improved performance when directly applied to heavily soiled or stained areas of laundry items prior to washing. This, however, requires additional sorting and pretreating before washing. Some pretreatment products have addressed this inconvenience by allowing consumers to pretreat the soiled laundry at any time before washing. Liquid laundry detergents do not currently offer this convenience.

It is known that enzymes require sufficient water for effective performance. Unfortunately, they cannot be stored in aqueous solutions for extended time periods at an effective concentration without degrading. Therefore, the enzymes in liquid laundry detergents and pretreatments cannot be fully activated without additional water in a presoak or wash cycle.

Presoaking can be an effective means of improving performance on heavy soils and stains. This method, however, does not achieve the direct contact and higher concentration advantages of laundry pretreatment products as does direct application of liquid laundry detergent. It is also considered inconvenient by many consumers.

BRIEF SUMMARY OF THE INVENTION

The present invention addresses these shortcomings by providing a liquid laundry detergent that can be converted into an effective pre-treatment formulation. In particular, the composition of the present invention will, when diluted with water, form a gel that will not run off a stained garment to which the product of the present invention has been applied.

The present invention therefore provides a liquid laundry detergent composition that includes an enzyme especially selected for its performance on protein-type stains. The detergent has been formulated with a minimal amount of water and a stabilizer for a long shelf life for the sensitive enzymes of the formulation. The product has been formulated such that while it is a liquid in its container, it turns into a gel of controlled viscosity upon dilution with additional water. The resulting gel effectively adheres to garments to ensure continuous contact with the soil until laundered. The transformation from a liquid to a gel is also effective in signaling to the user that the enzyme in the product has been activated by addition of sufficient water and is now working to remove stains.

In general therefore, the composition of the present invention includes from about 35% to about 75% of one or more nonionic surfactants, from about 10% to about 25% of one or more anionic surfactants, from about 5% to about 15% of a nonionic solubilizing agent, and from about 0.1% to about 1.5% of one or more enzymes, wherein the composition contains less than about 25% water. The composition is a liquid but when diluted with water in a ratio of 9:1 to 1:1 (composition to water), the composition forms a viscous gel.

In one embodiment, the present pretreatment composition consists essentially of from about 35% to about 75% nonionic surfactant, from about 10% to about 25% anionic surfactant, from about 5% to about 15% nonionic solubilizing agent, and from about 0.1% to about 1.5% enzyme, in which the above composition is a liquid containing less than about 25% water, and where dilution with water in a ratio of from about 9:1 to about 1:1 (pretreatment composition:water) forms a viscous gel useful in treating stains on clothing.

The composition of the present invention may also contain one or more surfactants and dispersants to aid in the breakup and solubility of the gel when it is further diluted with water, as when the treated garment is put into a washing machine for further laundering. Other ingredients may also be present to aid in gel formation, lend greater surfactancy, enhance aesthetics and utility of the detergent, and to aid in solubilizing the non-ionic surfactants in aqueous solutions.

Another aspect of the present invention is directed to a method of pretreating stained garments using the composition of the present invention. In this aspect, the composition is diluted with water, applied to a portion of fabric containing a stain, and allowed to remain on the stain for a period of time before washing. In a preferred embodiment, the composition is allowed to remain on the stained garment for at least ten minutes. It appears, however, that most of the benefit of using such a pretreatment is reached after thirty minutes. Therefore, extended treatment is not necessary. No detrimental effects on detergency, however, were observed when the pretreatment contact time exceeded twenty-four hours.

All percentages set forth in the following specification and appended claims are by weight unless otherwise noted.

DETAILED DESCRIPTION OF THE INVENTION

A laundry pretreatment composition should meet three criteria to be successful. The pretreatment should be convenient for the person doing the laundry and should be effective in removing stains that are difficult to remove. The pretreatment should also not interfere with other aspects of doing laundry, that is, the pretreatment should disperse when the clothing to which it is applied is placed into a washing machine and laundered. If the laundry pretreatment does not meet these criteria, consumers will not perceive the pretreatment as being useful.

A laundry pretreatment should be convenient for the person doing laundry. In order to meet this important consumer demand, the pretreatment should be available in liquid form, ready to apply, rather than a powder, which must be dissolved before it is applied to clothing. Applying a liquid directly to a stained garment is far more convenient than having to mix and apply a powdered detergent. Besides being convenient, a laundry pretreatment must also be effective. For a pretreatment product to be effective, it must remain in contact with the soil or stain, and should be specifically formulated to remove proteinaceous stains known to be difficult to remove. The pretreatment should also require a relatively short period of time to penetrate and begin to loosen stains and soil. Stains known to be especially difficult to remove include, but are not limited to those with protein content, including grass, blood, certain oils, milk, cocoa, foods, and the like. Surfactants in the detergent should attack the soil and stains, and begin to lift and solubilize soil and stains, as well as dirt and products from the action of the enzymes. Surfactants can be selected to enhance the removal of both polar and nonpolar oily soils including mineral oil, lubricating oils and greases, cooking oils, animal fats, and the like. A small amount of building action of the detergent should help suspend the dirt and prevent the dirt from redepositing on the clothing. Ideally, the gel should disperse and solubilize upon dilution with a greater amount of water, as when the clothing is subsequently put into a washing machine for a washing cycle. Finally, the pretreatment should not give a harsh feel to the treated garments after they are laundered and dried.

The present invention solves these problems by using a laundry pretreatment comprising one or more nonionic surfactants, one or more anionic surfactants, a compatibilizing agent, and an enzyme, where the amount of water in the formulation is less than about twenty five percent, and wherein an additional quantity of water causes the pretreatment to turn into a viscous gel.

Nonionic Surfactant

Nonionic surfactants comprise about half, by weight, of the detergent of this invention. The nonionic surfactant is desirably liquid, i.e. it has a melt point or melting range at normal chemical processing temperatures from about 10° C. to about 50° C. Suitable nonionic surfactant compounds fall into several different chemical types. These are generally polyoxyethylene or polyoxypropylene condensates of organic compounds having reactive hydrogen atoms. Illustrative examples of suitable nonionic compounds include, but are not limited to, the polyoxyethylene and polyoxypropylene condensates of aliphatic carboxylic acids and alcohols. The acids or alcohols may be branched or straight-chain, and may be saturated or unsaturated, containing from about 10 to about 18 carbon atoms in the aliphatic chain and incorporating from 3 to 12 ethylene oxide or mixtures of ethylene oxide and propylene oxide groups. Preferred nonionic surfactants for the invention are those made from linear primary alcohols, especially those having from about 12 to about 15 carbon atoms alkoxylated with from about 3 to about 12 oxide groups. Particularly preferred are those alcohols having from about 12 to about 15 carbon atoms and ethoxylated with from about 3 to about 12 ethylene oxide groups. They have the general structure $CH_3—(CH_2)_y—(O—CH_3—CH_2)_z—OH$, where the carbon chain is y+1, and the number of ethoxy or propoxy groups is z.

In general, the nonionic surfactant comprises from about 35% to about 75% of the pretreatment composition, preferably from about 40% to about 60%, and more preferably from about 45% to about 55%. One embodiment of the invention includes from about 40% to about 60% of a nonionic surfactant selected from the group consisting of ethoxylated linear primary alcohols that are ethoxylated with from about 3 to about 12 ethylene oxide groups per molecule of alcohol. This preponderance of liquid surfactant insures that the detergent will remain liquid when used in combination with other elements of the formula. The solubility and gel-forming capability of such ethoxylates, especially in aqueous systems, is primarily determined by the degree of ethoxylation, that is, the number of ethoxy groups appended to each molecule of alcohol. The greater the number of ethoxy groups, the greater the solubility in water. Given a sufficient number of ethoxy groups, some of the higher ethoxylates are capable of forming gels or dissolving in water by themselves, no combination of different ethoxylates being necessary.

A combination of ethoxylated non-ionic surfactants, however, provides a better and more economical solution, yielding a composite formulation with an appropriate hydrophilic-lipophilic balance (HLB) number. Such a composite nonionic surfactant will have the ability to usefully combine with the hydrophobic components of the composition of the present invention. The composite surfactant will also be able to disperse later in water, form a solution, and perhaps, in part, aid in suspension of the soil-lifting moieties of the formula in addition to solubilizing a wider variety of lipophilic soils.

A preferred combination includes about three parts higher ethoxylate and one part lower ethoxylate forms. It has been found that this preferred combination forms a stable gel. The higher ethoxylate preferably has from 7 to about 12 ethoxy groups per molecule, and the lower ethoxylate preferably has from about 3 to 6 ethoxy groups per molecule. This combination is particularly effective when used, as mentioned above, in the context of $C_{12}$-$C_{15}$ linear primary alcohols. A number of combinations may be used, and a better gel is obtained when using combinations at the limits of the specifications above. Thus, using a $C_{12}$-$C_{15}$ alcohol having 9 ethoxy groups and a $C_{12}$-$C_{15}$ alcohol having 3 ethoxy groups in a 4:1 ratio results in a pretreatment composition that yields a very soft gel that is also very soluble. In contrast, using a $C_{12}$-$C_{15}$ alcohol with 7 ethoxy groups and a $C_{12}$-$C_{15}$ alcohol with 3 ethoxy groups in a 3:1 ratio provides a gel that is firmer but is more difficult to disperse than the combination containing the 4:1 ratio.

It has been found that an effective nonionic surfactant is a combination of (a) from about 60% to about 95% of a linear primary $C_{10-16}$ alcohol ethoxylated with an average of 7 ethylene oxide groups and (b) from about 5 to about 40% of a linear primary $C_{10-16}$ alcohol ethoxylated with an average of 3 ethylene oxide groups. A more desirable nonionic surfactant is a combination of (a) from about 60% to about 95% of a linear primary $C_{12-15}$ alcohol ethoxylated with an average of 7 ethylene oxide groups and (b) from about 5 to about 40% of a linear primary $C_{12-15}$ alcohol ethoxylated with an average of 3 ethylene oxide groups.

Compatibilizing Agent

The preferred mix of nonionic surfactants provides excellent detergency properties, especially in combination with the preferred enzyme, to attack and lift soil and stains in clothing. In spite of their excellent properties, however, these nonionic surfactants are not readily soluble in water. Therefore, the detergent and pretreatment composition typically includes a disperser or compatibilizing agent, both for its utility in pretreatment as well as later in dispersing in a washing machine. Alcohols and ethers such as glycol ethers with two to six carbon atoms serve this purpose. Lower molecular weight alcohols and dihydric alcohols serve well to aid in lowering the viscosity of the nonionic combination for ease in handling and lowering the hydrophlic balance to favor water solubility. In particular, lower aliphatic alcohols having 2 to 10 carbon atoms and from 1 to 3 hydroxyl groups, and ethers of diethylene and propylene glycol are useful in compatibilizing the nonionic surfactants of this invention.

Glycol ethers useful in the present invention are water-soluble glycol ethers according to the general structure $R_a—O—R_b—OH$, where $R_a$ is an alkoxy of one to six carbons atoms and $R_b$ is an ether condensate, such as ethylene glycol or propylene glycol, preferably having one to five glycol monomer units. These glycol ethers, which may be advantageously employed, include diethylene glycol methyl ether, propylene glycol methyl ether, and similar compounds. These materials are available commercially under the trade name Dowanol from the Dow Chemical Co. (Midland, Mich.) and Cellosolve from the Union Carbide Corp., now a subsidiary of the Dow Chemical Co. Also useful in practicing the invention are the other alcoholic moieties mentioned above, including glycols with from 2 to 6 carbon atoms. The glycols are preferred, especially those with 2 to 6 carbon atoms, branched chain or linear. Particularly preferred is hexylene glycol, 2-methyl-2-4-pentanediol, which provides excellent dispersing ability as well as stability to the laundry detergent and pretreatment during its shelf life.

The compatibilizing agent is present in the formula from about 1% to about 20% by weight, preferably from about 5% to about 15%, and more preferably in an amount of about 11% to about 13%.

Anionic Surfactants

In addition to the ingredients mentioned above, at least one anionic surfactant is desirably used in formulating the laundry detergent and pretreatment composition. Such an anionic surfactant, being more soluble in water than the nonionics, may be useful in dispersing the detergent when the soiled garments are eventually placed into a washing machine, or alternatively, are laundered by hand. In addition, an anionic surfactant may aid in solubilizing the stains and dirt once the enzyme and nonionic surfactant loosen them from the garment. Anionics are also useful in dispersing the gel itself, once the garment and the gel upon it are placed into a larger volume of water, such as in a washing machine. Some anionics may also lend a softening touch or "hand" to the garment after it is laundered and dried. Even if the softening effect is not pronounced, it may be desirable merely to avoid a "harsh" feel that may result after the garments are exposed to high temperature wash water or a high temperature drying cycle.

A desirable anionic is a soap formed from $C_{12}$–$C_{20}$ fatty acids and bases such as sodium hydroxide, potassium hydroxide, ammonia, morpholine, alkanolamines and mixtures thereof. Such soaps are useful for their surfactant properties and ability to add a soft hand to the garment, as well as its aid in forming a gel when the liquid laundry pretreatment detergent is diluted to a small extent with water. Anionics formed from fatty acids with long aliphatic chains are known to be useful in fabric softening. Alkanolamines with one to several hydroxyl groups are useful, such as monoethanolamine, diethanolamine, and triethanolamine. Soaps such as these may be added and mixed thoroughly into the detergent. Thus, if a monoethanolamine soap with a $C_{18}$ chain is desired, the requisite amount of monoethanolamine is added to a fatty acid such as oleic acid or stearic acid. The resulting soap will be useful as an anionic surfactant.

In practicing this invention, the longer $C_{16}$–$C_{20}$ fatty acids are preferred and linear acids are preferred, rather than branched, for the desirable softening effect. A disadvantage of this method is that the soap thus formed will precipitate in small particles, and will be very difficult to disperse throughout the detergent solution. However, the soap may be formed in situ, by adding its precursors, the chemical reagents that react to form the soap. Thus, when the second of the two reagents is added, the soap is formed in the solution. By virtue of its formation in the solution while ingredients are being mixed, its otherwise problematic dispersal is reduced, and the soap is widely dispersed. It is preferred that saturated and monounsaturated $C_{16}$–$C_{18}$ fatty acids be used, and a preferred embodiment uses palmitoleic acid or oleic acid. It is also preferred to use the saturated or monounsaturated $C_{16}$–$C_{18}$ fatty acids in combination with 2-aminoethanol to form a soap useful in the present invention.

The anionic surfactant is generally present in the composition in an amount from about 5% to about 25%, preferably in an amount from about 10% to about 20%. In this regard, it has been found that from about 1 to about 20% of the formulation of fatty acid is useful in imparting desirable properties to the detergent of this invention. The corresponding amount of alkanolamine should also be added, roughly stoichiometric, but it has been found that variances from stoichiometric, preferably resulting in an alkaline final product, do not cause disadvantages to detergent performance. Preferred is an embodiment that consists of about 10% of the fatty acid, with the corresponding amount of alkanolamine. Highly preferred is a formulation with about 10% oleic or palmitoleic acid and about 2% by weight of monoethanolamine.

It is also beneficial to add a second anionic surfactant that will aid generally in surfactancy, that is, in loosening dirt and soil. Moreover, a second anionic surfactant has been found to modify the hand or feel of garments when the garments are laundered and dried after receiving the pretreatment of the present invention. Certain anionic surfactants will also aid in the formation of a gel with the bulk of the nonionic surfactants above.

Anionic surfactants suitable for this purpose are salts of sulfonated esters of fatty acids. It is believed that the long chain contributes to the hand of the garment, while the ionic portions of the molecule contribute to the surfactant and gel-forming properties of these compounds. Especially favored are the $C_{12}$–$C_{18}$ chains, and their short-chain esters, especially $C_1$–$C_4$ esters. A preferred embodiment uses the $C_{12}$–$C_{16}$ chains and the methyl esters thereof. Particularly preferred are anionics, which have a sulfonate group alpha to the carbonyl, that is, an alpha-sulfo methyl ester of a $C_{12}$–$C_{16}$ fatty acid. Other suitable anionic surfactants include alcohol sulfates and ethoxy sulfates.

In one embodiment of the invention, from about 1% to about 20% is desirably added to the pretreatment formulation, by weight. A preferred embodiment uses from about 1% to about 10%, more preferably about 3% of the sodium salt of alpha-sulfo-methyl cocoate, independent of water content. These products are available commercially already dispersed in aqueous solution containing about two-thirds water. While the composition of the present invention generally does not contain a classic builder as such, the combination of these anionics lends sufficient capability to modify the hardness of the small amount of pretreatment water used to dilute the detergent and pretreatment composition and form a gel.

Enzymes

The enzymes used in this invention are those that preferentially aid in removing stains. Each enzyme of this invention functions by promoting hydrolysis of specific organic linkages. Proteolytic enzymes, those that digest protein, may be of vegetable, animal or microorganism origin. Preferred enzymes are those of microorganism origin, which include yeast, fungi, molds, and bacteria. Particularly preferred in this invention are subtilisin-type proteases. Subtilisins are alkaline proteases that are secreted by members of the genus bacillus. A protease is a protein-digesting enzyme, and in particular is effective in hydrolyzing peptide linkages. Thus, proteases have properties that make them valuable to the detergent industry. They have high specific activity on proteinaceous substances, they function optimally at moderate temperatures, and they are stable under alkaline conditions. Subtilisins gain part of their stability by binding calcium.

We have found that performance advantages may be gained in the cleaning process by using subtilisin enzymes that have been processed to remove or reduce the calcium present in the enzyme formulation. The enzyme need be present in the finished formulation of pretreatment detergent in a small amount, generally less than about 5%, preferably from about 0.001% to about 2%, more preferably from about 0.01% to about 1.5%. In a particularly preferred embodiment, the enzyme is at a level of about 0.1% to about 1.5%. A particularly preferred embodiment utilizes protease available from Novo Nordisk of Denmark under the trade name of "Savinase® 16.0 L EX." References to concentrations of enzyme in the specification and claims herein refer to the concentration of enzyme as commercially supplied.

Enzymes are known to have relatively short shelf lives, especially when subject to denaturation or autolysis. This degradation is accelerated in highly aqueous environments. In particular, enzymes that are present in highly aqueous environments are known to lose their effectiveness. One aspect of the invention is to limit the amount of water in the detergent and pretreatment formulation, such that the enzymes have long shelf lives and do not deteriorate over time. Accordingly, while some amount of water is necessary to provide the composition of the present invention, the amount is preferably small, and is generally less than about 25% by weight, preferably less than about 20%. The amount of free water in the formulation of this invention is more preferably less than 15%.

The invention is not limited to proteases, although they are the preferred enzymes. Other enzymes useful in combination with proteases are enzymes useful in attacking other types of stains, such as those caused primarily by fats and oils. Particularly useful enzymes are carbohydrases and lipases, as well as cellulases, oxidases, and esterases.

Water

The formulation of this invention must be such that the detergent and pretreatment composition will form a gel when it is diluted with water, i.e., when a person mixes the detergent and pretreatment composition with a small amount of water. This amount of water, when incorporated into the formula of the present invention, is preferably sufficient to gel the detergent and pretreatment composition and activate the enzyme. In one embodiment of the formula, nine parts of liquid laundry detergent and pretreatment composition may be combined with one part to nine parts of water. This amount of water is sufficient to form a gel, and the gel will then wet the clothing, beginning its task of penetrating, lifting and suspending the soils. At the same time, the gel is sufficiently thick that it does not run off the clothing, but rather stays in place and continues to work on removing stains from the clothing.

It has been found that the amount of soft water present in the detergent and pretreatment composition is generally less than about 25%, preferably less than about 20%, more preferably from about 10% to about 15%, and most preferably between 11% and 13%. This amount of water in the formulation is sufficient to keep the formulation stable and liquid, is but not so much as to activate the enzyme present and cause it to degrade.

The detergent and pretreatment composition may contain limited amounts of optional ingredients so long as they do not detract from the advantageous benefits resulting from the composition of the present invention. In general, such optional ingredients are present in the invention in an aggregate amount of less than about 10%, preferably less than about 5%. Such optional ingredients include fluorescent whiteners and fragrances.

A fluorescent whitener is useful for the visual whitening effect it creates through fluorescence. This effect is primarily beneficial when applied to a white or near-white substrate, such as white clothing. Thus, it is seen that such a whitener will be most effective on white or light-colored clothing, particularly such clothing that has been soiled with a stain that is hard to remove. A whitener, by creating a visual whitening effect on such a garment, will be perceived as having a positive influence on the laundry.

Fluorescent whiteners used in laundry detergents have certain features in common. These features include: (a) a conjugated, planar double bond system; (b) monomolecular distribution; (c) substantivity to fabrics; (d) the ability to absorb ultraviolet radiation between 300–400 nm (but not above 410 nm) and to emit visible blue light between 400 and 500 nm with maximal emission around 430–436 nm. In addition, fluorescent whiteners must meet other criteria, e.g., safety, stability, compatibility, solubility and cost.

The major class of fluorescent whiteners used in the U.S. in laundry detergents is the diaminostilbenedisulfonatecyanuric chloride derivatives (DAS/CC). Only the relatively stable, planar, trans-form of these whiteners is substantive to fabrics and exhibits the desired fluorescence. The predominant group of DAS/CC derivatives used is the 4,4'-bis[(4-anilino-6-substituted-1,3,5-triazin-2yl)amino]stilbene-2,2'-disulfonic acids in which the substituted group is either morpholino, hydroxyethylmethylamino, dihydroxyethylamino, or methylamino. These derivatives differ, to varying degrees, in water solubility, reduction of effectiveness by nonionic surfactants, coloration of detergent powders and chlorine bleach stability. Some of these properties are influenced as much by the crystalline form of the whitener as they are by the nature of the substituted chemical group. Another major type of whitener is a naphthotriazolylstilbene whitener (NTS). One specific example used in laundry detergents is the sodium salt of 5-(2H-naphtho[1,2-d]triazol-2-yl)-2-(2-phenylethenyl)-benzene sulfonic acid. A newer fluorescent whitener that is in more limited use is one made from stilbene triazole. One specific example used in laundry detergents is 4,4'-bis(4-phenyl-1,2,3-triazol-2-yl)-stilbene-2,2'-disulfonic acid disodium salt. Another major type of fluorescent whitener used in heavy-duty laundry detergents is a distyrylbiphenyl (DSBP)-type. A specific example is 2,2-(4,4'-biphenylene divinylene) dibenzenesulfonic acid, disodium salt. Any of these whiteners are suitable for the laundry detergent and pretreatment of the present invention, so long as the whitener is soluble in the pretreatment laundry detergent.

The whitener may be included in the composition in an amount from about 0.1% to about 5%, preferably from about 1% to about 5%.

Fragrances are effective and useful in disguising base odors, and in imparting a pleasing scent to the pretreatment detergent. Fragrances are effective when added in an amount from about 0.01% to about 2.0%, preferably from about 0.1% to about 1.0%.

Another aspect of the invention is an embodiment which makes use of the laundry pretreatment more convenient to the consumer, while at the same time helping to ensure that the consumer uses the product properly. The laundry detergent and pretreatment of this invention must be diluted with water by the consumer for two reasons: to activate the enzyme and to form a gel, which will cling to the soiled clothing. It is helpful to the consumer if packaging is provided which encourages the consumer to add the proper amount of water to the detergent. As noted above, in the preferred embodiment, nine parts of the detergent and pretreatment composition are diluted by one to nine parts of water to form a viscous gel.

In this regard, the detergent and pretreatment composition, as formulated, has a viscosity in the range of about 300 to about 500 cps (measured using Brookfield viscometer with a #2 spindle at room temperature). Upon dilution with water within the range of 1:1 to 9:1 (composition to water), the viscosity of the diluted composition at room temperature increases to a range from about 850 to about 50,000 cps.

In one example, the viscosity of the liquid detergent and pretreatment product was measured as 450 cps at 6 rpm using a Brookfield viscometer with a #2 spindle at 22° C. After dilution with soft water at 3:1, the viscosity was measured as about 950 cps at the same Brookfield settings. At 4:1 dilution, viscosity rose to about 5,400 cps using spindle #3 at 6 rpm and at 5:1 dilution viscosity was about 7,000 cps using spindle #3 at 6 rpm on the Brookfield LVT viscometer. Dilution at a 9:1 ratio will provide a viscosity of about 50,000 cps.

One preferred embodiment of the present invention consists essentially of from about 35% to about 40%, preferably about 37.5% nonionic surfactant of a $C_{12}$–$C_{15}$ linear primary alcohol ethoxylated with from 7 to about 12 ethylene oxide groups per molecule of alcohol, from about 10% to about 15%, preferably about 12.5% nonionic surfactant $C_{12}$–$C_{15}$ linear primary alcohol ethoxylated with from about 3 to 6 ethylene oxide groups per molecule of alcohol, from about 5% to about 15%, preferably about 10% oleic acid, from about 5% to about 15%, preferably about 10% of a solution of the sodium salt of alpha-sulfo-methyl cocoate, from about 1% to about 3%, preferably about 2% ethanolamine, from about 10% to about 15%, preferably about 12.5% hexylene glycol, and from about 0.1% to about 1.5%, preferably about 0.75% enzyme, with the balance being water. Such a composition will preferably be a watery liquid and dilution with more water, in a ratio of 9:1 (composition:water) up to 1:1 (composition:water) will form a viscous gel.

Another aspect of the invention provides a method of pretreating stained garments, in which the improved composition of the invention is applied to a stained or soiled garment. A stained garment is provided, and a portion of the liquid laundry detergent and pretreatment composition is also provided. The pretreatment composition is diluted in a ratio of from about 1 part of water to about 9 parts of composition, to about 9 parts of water to about 9 parts of composition. When the composition is diluted, a gel forms. The gel is then applied to the soiled garment, and particularly to the area of the soil or stain.

In a preferred embodiment of the method, the pretreatment composition is allowed to wait for ten minutes before further laundering. Tests have shown a benefit after ten minutes, but it is not necessary to wait ten minutes for some benefit to accrue, since the composition will begin working immediately to solubilize and loosen soil and dirt. Tests have also shown that, although there is an increased benefit in soil and stain removal for up to 24 hours after application to a stained garment, it appears that most of the benefit is achieved within thirty minutes after application.

Of course, it should be understood that a wide range of changes and modifications can be made to the embodiments described above. It is therefore intended that the foregoing description illustrates rather than limits this invention, and that it is the following claims, including all equivalents, which define this invention.

What is claimed:

1. A method of forming a gel pretreatment composition for treating a stained fabric, comprising:

a. providing a surfactant-containing liquid composition having a viscosity in the range from about 300 cps to about 500 cps and comprising
   i. from about 35% to about 75% nonionic surfactant;
   ii. from about 10% to about 25% anionic surfactant;
   iii. from about 5% to about 15% nonionic solubilizing agent;
   iv. from about 0.1% to about 1.5% enzyme; and b. adding an amount of water to provide a ratio of 9:1 (composition:water) to 1:1 (composition:water) to form a gel having a viscosity in the range from about 850 cps to about 50,000 cps.

2. The method of claim 1, wherein the surfactant-containing composition further comprises water in an amount less than about 25%.

3. The method of claim 1, wherein the nonionic surfactant is from about 40% to about 60%, and the anionic surfactant is from about 10% to about 20%.

4. The method of claim 1, wherein the nonionic surfactant is a combination of:

a. from about 60% to about 95% of a $C_{10}$–$C_{16}$ alcohol, ethoxylated with an average of about seven ethylene oxide groups; and b. from about 5% to about 40% of a $C_{10}$–$C_{16}$ alcohol, ethoxylated with an average of about three ethylene oxide groups.

5. The method of claim 1, wherein the nonionic surfactant is a combination of:

a. from about 60% to about 95% of a $C_{12}$–$C_{15}$ alcohol, ethoxylated with an average of about seven ethylene oxide groups; and b. from about 5% to about 40% of a $C_{12}$–$C_{15}$ alcohol, ethoxylated with an average of about three ethylene oxide groups.

6. The method of claim 1, wherein the anionic surfactant is formed in situ by providing from about 10 to about 20% saturated or monounsaturated $C_{12}$–$C_{20}$ fatty acid and about 2 to about 5% alkanolamine.

7. The method of claim 6, wherein the fatty acid is $C_{16}$–$C_{18}$, and the alkanolamine is monoethanolamine.

8. The method of claim 1, wherein the anionic surfactant comprises an anionic surfactant formed in situ by providing from about 5% to about 20% saturated or monounsaturated $C_{12}$–$C_{20}$ fatty acid and from about 2% to about 5% alkanolamine, and from about 2% to about 5% of a sodium salt of a $C_1$–$C_4$ ester of a sulfonated $C_{12}$–$C_{18}$ fatty acid.

9. The method of claim 8, wherein the fatty acid is $C_{12}$–$C_{16}$, and the ester is the methyl ester.

10. The method of claim 1, wherein the solubilizing agent is selected from the group consisting of $C_2$–$C_6$ glycols and $C_2$–$C_6$ glycol ethers.

11. The method of claim 1, wherein the solubilizing agent is hexylene glycol.

12. The method of claim 1, wherein the enzyme is present in an amount of about 0.75%.

13. A method of forming a gel pretreatment composition for treating a stained fabric comprising:

a. providing a surfactant-containing liquid composition having a viscosity in the range from about 300 cps to about 500 cps and comprising i. about 50% of a nonionic surfactant wherein the nonionic surfactant is a combination of about 75% $C_{12}$–$C_{15}$alcohol ethoxylated with about 7 ethylene oxide groups; and about 25% $C_{12}$–$C_{15}$alcohol, ethoxylated with about ethylene oxide groups;

ii. about 10% oleic acid;

iii. about 3.5% an aqueous solution of a sodium salt of alpha-sulfo methyl cocoate;

iv. about 2% ethanolamine;

v. about 12.5% hexylene glycol;

vi. about 0.75% enzyme; and vii. the balance water wherein the composition contains less than about 25% water; and b. adding an amount of water to provide a ratio of 1:1 (composition:water) up to 9:1 (composition:water) to form a gel having a viscosity in the range from about 850 cps to about 50,000 cps.

14. A method of pretreating stained garments, comprising:

a. providing a liquid laundry detergent and pretreatment composition, wherein the composition comprises i. from about 35% to about 75% nonionic surfactant;

ii. from about 10% to about 25% anionic surfactant;

iii. from about 5% to about 15% nonionic solubilizing agent; and iv. from about 0.1% to about 1.5% enzyme; wherein the composition contains less than about 25% water;

b. diluting 9 parts of the composition with from about 1 to about 9 parts of water, wherein the resulting composition forms a gel; and c. applying the gel to at least one stain on a stained garment.

* * * * *

UNITED STATES PATENT AND TRADEMARK OFFICE

CERTIFICATE OF CORRECTION

PATENT NO. : 6,534,462 B1
DATED : March 18, 2003
INVENTOR(S) : Robert W. Hamilton et al.

It is certified that error appears in the above-identified patent and that said Letters Patent is hereby corrected as shown below:

Title page, Item [54] and Column 1, lines 1 and 2,
Delete "LIQUID LAUNDRY DETERGENT AND PRETREATMENT COMPOSITION", and substitute -- METHOD FOR FORMING A GEL COMPOSITION AND METHOD OF USING SAME --.

Column 10,
Line 14, immediately after "comprising" insert -- : -- (colon).
Lines 48 and 54, delete "in situ" and substitute -- *in situ* -- in its place.

Column 11,
Line 5, immediately after "comprising" insert -- : -- (colon).
Line 10, before "ethylene" insert -- 3 --.

Signed and Sealed this

Sixth Day of January, 2004

JAMES E. ROGAN
*Director of the United States Patent and Trademark Office*